US009633806B2

(12) United States Patent
Krehnke et al.

(10) Patent No.: US 9,633,806 B2
(45) Date of Patent: Apr. 25, 2017

(54) SWITCHING ARRANGEMENT

(71) Applicant: SIEMENS AKTIENGESELLSCHAFT, Munich (DE)

(72) Inventors: Martin Krehnke, Berlin (DE); Friedrich Loebner, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/411,757

(22) PCT Filed: Jun. 19, 2013

(86) PCT No.: PCT/EP2013/062674

§ 371 (c)(1),
(2) Date: Dec. 29, 2014

(87) PCT Pub. No.: WO2014/001160

PCT Pub. Date: Jan. 3, 2014

(65) Prior Publication Data

US 2015/0162149 A1 Jun. 11, 2015

(30) Foreign Application Priority Data

Jun. 29, 2012 (DE) ..... 10 2012 211 376

(51) Int. Cl.
*H01H 33/12* (2006.01)
*H01H 33/42* (2006.01)
(Continued)

(52) U.S. Cl.
CPC ..... *H01H 33/12* (2013.01); *H01H 33/42* (2013.01); *H01H 3/42* (2013.01); *H01H 33/245* (2013.01); *H01H 33/7023* (2013.01)

(58) Field of Classification Search
CPC ..... H01H 33/12; H01H 33/187; H01H 33/24; H01H 33/28; H01H 33/56; H01H 33/60;
(Continued)

(56) References Cited

U.S. PATENT DOCUMENTS 5,025,118 A 6/1991 Meinherz et al.
6,177,643 B1 * 1/2001 Marin ..... H01H 33/245 218/45

(Continued)

FOREIGN PATENT DOCUMENTS

CN 201570435 U 9/2010
DE 19702822 C1 3/1998

(Continued)

*Primary Examiner* — Renee S Luebke
*Assistant Examiner* — William Bolton
(74) *Attorney, Agent, or Firm* — Laurence Greenberg; Werner Stemer; Ralph Locher

(57) ABSTRACT

A switching configuration includes a first switching contact set having a rated current contact piece and an arcing contact piece. The arcing contact piece and the rated current contact piece of the first switching contact set are movable relative to one another through a transmission mechanism. The arcing contact piece is supported by a support element on a contact carrier of the rated current contact piece. The transmission mechanism has a transmission mechanism chassis which is supported, particularly directly, on the contact carrier.

6 Claims, 3 Drawing Sheets

(51) Int. Cl.
*H01H 33/24* (2006.01)
*H01H 33/70* (2006.01)
*H01H 3/42* (2006.01)

(58) Field of Classification Search
CPC .. H01H 33/7023; H01H 33/42; H01H 33/901; H01H 33/245; H01H 2001/508; H01H 2033/028; H01H 33/04; H01H 33/70; H01H 33/02; H01H 33/025
USPC ..... 218/14, 16, 18–21, 57, 63, 65, 84, 45
See application file for complete search history.

(56) References Cited

U.S. PATENT DOCUMENTS

| | | | | |
|---|---|---|---|---|
| 6,271,494 | B1 | 8/2001 | Dienemann et al. | |
| 7,699,666 | B2 | 4/2010 | Hoehne et al. | |
| 7,902,478 | B2 | 3/2011 | Kriegel et al. | |
| 7,994,442 | B2 | 8/2011 | Vestner et al. | |
| 2008/0083704 | A1* | 4/2008 | Ozil ..... | H01H 33/904 218/154 |
| 2010/0163527 | A1* | 7/2010 | Yoon ..... | H01H 33/904 218/62 |
| 2011/0120975 | A1* | 5/2011 | Nufer ..... | H01H 33/901 218/63 |

FOREIGN PATENT DOCUMENTS

| | | | |
|---|---|---|---|
| DE | 19741660 | A1 | 3/1999 |
| DE | 102005012930 | A1 | 9/2006 |
| EP | 1879207 | A1 | 1/2008 |
| WO | 2007087733 | A1 | 8/2007 |

* cited by examiner

SWITCHING ARRANGEMENT

BACKGROUND OF THE INVENTION

Field of the Invention

The invention relates to a switching arrangement that comprises a first switching contact set having a rated current contact piece and an arcing contact piece that are arranged in such a manner that they can be moved relative to one another, wherein the arcing contact piece is supported on a contact carrier of the rated current contact piece by way of a supporting element and said switching contact set also has a transmission mechanism for the purpose of generating a relative movement between the arcing contact piece and the rated current contact piece.

A switching arrangement of this type is by way of example disclosed in the patent application DE 197 41 660 A1. The patent application describes a switching arrangement in the form of a high voltage circuit breaker and said switching arrangement comprises a first contact set having a rated current contact piece and an arcing contact piece. The rated current contact piece and the arcing contact piece of the first switching contact set are arranged in such a manner that they can be moved relative to one another. The arcing contact piece is supported on a contact carrier of the rated current contact piece by way of a supporting element. A transmission mechanism is installed between the rated current contact piece and the arcing contact piece for the purpose of generating a relative movement.

The transmission mechanism at this location is attached to the supporting element of the arcing contact piece. Consequently, it is ensured that the arcing contact piece and the transmission mechanism are positioned in alignment with respect to one another so that a precise relative movement between the arcing contact piece and the rated current contact piece of the first switching contact set is rendered possible. The disadvantage with this construction is that forces that originate from the transmission mechanism are absorbed by way of the supporting element of the arcing contact piece. In addition to the forces that occur in the case of a supporting arrangement of the arcing contact piece, it is also necessary for the supporting element to withstand the transmission mechanism forces.

During the course of improving the efficiency of switching arrangements it is desirable to increase the switching speed of the switching arrangement, whereby moving parts such as by way of example the arcing contact piece are subjected to increased positive and also negative accelerations. Accordingly, increased forces occur on moving parts, by way of example also of the transmission mechanism. As a result of improving the efficiency of known switching arrangements, the moving masses and consequently the forces that arise become ever greater. Economically, it is almost impossible using the known construction to overcome the forces that occur.

BRIEF SUMMARY OF THE INVENTION

Accordingly, the object of the invention is to provide a switching arrangement that comprises an improved capability to withstand increased forces.

In accordance with the invention, the object is achieved in the case of a switching arrangement of the type mentioned in the introduction by virtue of the fact that a transmission mechanism chassis of the transmission mechanism is supported on the contact carrier in particular in a direct manner.

A transmission mechanism comprises moving parts such as by way of example shafts, axles, levers, pins, push rods, threaded rods etc. The individual moving parts of the transmission mechanism are to be held in position relative to one another. The moving parts of the transmission mechanism are positioned by means of a transmission mechanism chassis. The transmission mechanism chassis can by way of example be embodied as a closed or open transmission mechanism housing. It is rendered possible by means of the transmission mechanism to generate a relative movement of an arcing contact piece and also a rated current contact piece of a first switching contact set. By way of example, it is possible by way of the transmission mechanism to transfer a drive movement of a switching contact piece to a further switching contact piece, by way of example an arcing contact piece, and thus to bring about a relative movement between a rated current contact piece and an arcing contact piece of the first switching contact set. Advantageously, a movement that is coupled into the transmission mechanism by way of example a linear movement should be converted or rather deflected. In the case of a coupled-in linear movement, it is possible by way of example, to reverse the direction of said movement so that in turn a linear movement, in particular one that is aligned parallel to the coupled-in movement, is impressed on the arcing contact piece. The transmission mechanism is preferably embodied as a deflection transmission mechanism.

The arcing contact piece and also the rated current contact piece of the first switching contact set are part of a clearance between open contacts of the switching arrangement, wherein a coaxially opposing second switching contact set is allocated to the first switching contact set. Likewise as in the first switching contact set, the second switching contact set comprises a rated current contact piece and also an arcing contact piece, wherein the arcing contact pieces of the two switching contact sets and also the rated current contact pieces of the two switching contact sets are embodied in a coaxially opposing manner so that rated current contact pieces and arcing contact pieces of the two switching contact sets can contact one another in a galvanic manner. The rated current contact piece and the arcing contact piece of the first or accordingly the second switching contact set are in each case permanently in electrical contact with one another so that they are always at the same electrical potential. The arcing contact pieces are used to protect the rated current contact pieces against contact erosion as a result of a switching arc. Switch-off arcs or switch-on arcs are preferably conducted at the arcing contact pieces. For this purpose, the arcing contact pieces are closed in advance in the case of a switching on process with respect to the rated current contact pieces, wherein in the case of a switching off process, the arcing contact pieces separate with respect to the rated current contact pieces at a later point in time.

A relative movement of the rated current contact pieces and also of the arcing contact pieces can be performed in such a manner that a drive movement is coupled-in to one of the switching contact sets and said drive movement is generated by a drive arrangement. By way of example, the arcing contact piece and the rated current contact piece of the second switching contact set can be connected to the drive arrangement by way of a kinematic chain so that it is possible to generate a relative movement between the first switching contact set and the second switching contact set. By way of example, a movement of the first switching contact set can also be transferred by way of a kinetic chain to the arcing contact piece or the rated current contact piece or both to the arcing contact piece and also the rated current contact piece of the first switching contact set. The transmission mechanism is part of this kinematic chain and said transmission mechanism advantageously functions as a deflection transmission mechanism. The deflection transmission mechanism transfers by way of example a movement that is performed by the second switching contact set (or rather its arcing contact piece and/or its rated current contact piece) to the arcing contact piece and/or the rated current contact piece of the first switching contact set. The transmission mechanism transforms the transferred movement. Consequently, it is possible that, during a switching process, both the rated current contact piece and the arcing contact piece of the second switching contact set and also the arcing contact piece of the first contact set are moved towards one another or alternatively away from one another. The rated current contact piece of the first switching contact set can remain idle and stationary or where necessary can also be moved.

The kinematic chain that is used to transfer a drive movement to one of the switching contact pieces or to the two switching contact pieces of the first switching contact set can be equipped with an electrically insulating section so that a mechanical connection is provided between the switching contact sets by way of the clearance between open contacts of the switching arrangement. A short circuit of the clearance between open contacts is prevented as a result of the electrically insulating section.

The transmission mechanism chassis of the transmission mechanism supports and guides the moving parts of the transmission mechanism. By way of example, the transmission mechanism can be a lever transmission mechanism that reverses the direction of a linear movement by means of a by way of example two-armed deflection lever and transfers said movement onto the arcing contact piece. The transmission mechanism chassis can be connected in particular in a direct manner to the contact carrier of the rated current contact piece of the first switching contact set. By way of example, the transmission mechanism chassis can be screwed to the contact carrier so that it is rendered possible to repeatedly detach and also fasten the transmission mechanism chassis of the transmission mechanism. Consequently, by way of example it is possible to perform maintenance on the transmission mechanism. The transmission mechanism chassis can be equipped with corresponding supporting feet so that the transmission mechanism chassis is supported on the contact carrier. By way of example, the contact carrier is a hollow cylindrical body on which is mounted the rated current contact piece of the first switching contact set. Accordingly, the contact carrier is used on the one hand to mechanically hold the rated current contact piece and on the other hand the contact carrier is also part of a current path, in order to provide an electrical current path to the rated current contact piece and also to the arcing contact piece of the first switching contact set. Consequently, it is ensured that irrespective of the switching position of the switching contact sets of the switching arrangement, the rated current contact piece and also the arcing contact piece of the first switching contact set is permanently at the same electrical potential. By way of example, the supporting element can be used for the purpose of electrically contacting the rated current contact piece and the arcing contact piece of the first switching contact set and the arcing contact piece is supported by way of said supporting element on the contact carrier of the rated current contact piece. By way of example, the supporting element can render possible a movable mounting arrangement of the arcing contact piece of the first switching contact set. For this purpose, the supporting element can comprise a bushing in which the arcing contact piece is guided in such a manner that it can move. By way of example, the supporting element can be embodied as a connecting piece that is arranged on the inner peripheral face of a contact carrier that is embodied as a hollow cylinder. In the case of an essentially circular cross section of the contact carrier, the connecting piece can lie by way of example on a diameter that is arranged in a cavity of the hollow cylindrical contact carrier. A bushing can be arranged in a central area in the connecting piece and the arcing contact piece is guided within said bushing in such a manner that it can be displaced in a linear manner. By way of example, a permanent electrical contact of the connecting piece/supporting element to the arcing contact piece can be provided by way of sliding contacts so that a current path to the contact carrier of the rated current contact piece of the first switching arrangement is formed. Accordingly, a permanent contact of the rated current contact piece and the arcing contact piece of the first switching contact is provided by way of the supporting element. The arcing contact piece and the rated current contact piece are advantageously supported in each case on the same contact carrier. A supporting arrangement of the arcing contact piece and the rated current contact piece can in each case advantageously occur independently from one another. Consequently, it is possible to direct forces that originate in the arcing contact piece and the rated current contact piece independently from one another into the contact carrier. Prior to directing the forces into the contact carrier, it is not possible for the forces to become superimposed and consequently said forces do not interact with one another.

A further advantageous embodiment can provide that the supporting element is spanned by a bearing flank of the transmission mechanism chassis that is supported on the contact carrier and in particular in such a manner that said transmission mechanism chassis is spaced apart from said support element.

A transmission mechanism chassis can preferably be equipped with a bearing flank that on the one hand positions and mounts pins, shafts, levers, guiding tracks etc. of the transmission mechanism. On the other hand, the bearing flank can itself be used as a guiding and directing element for components of the transmission mechanism that move relative to one another. The bearing flank can advantageously be supported on the contact carrier, wherein the bearing flank even spans the supporting element so that a mechanical decoupling is provided between the bearing flank and the supporting element. Forces cannot thus directly transfer from the supporting element to the bearing flank of the transmission mechanism chassis and conversely. Both the supporting element and also the transmission mechanism chassis are attached to the contact carrier independently from one another so that forces that originate from the transmission mechanism and also forces that originate from the supporting element are directed into the supporting contact carrier. As a consequence, the supporting element can be dimensioned, designed and constructed independently from the transmission mechanism chassis. Likewise, the transmission mechanism chassis can be designed, embodied and constructed independently of the construction of the supporting element.

The supporting element that preferably extends in accordance with a type of connecting piece through a cavity of a hollow cylinder that has an essentially circular cylindrical cross section can be arranged by way of example in the direction of the cylinder axis of the contact carrier in alignment with and almost overlapping the transmission mechanism chassis of the transmission mechanism, wherein a gap is formed between a bearing flank of the transmission mechanism chassis and the supporting element.

A further advantageous embodiment can provide that the transmission mechanism chassis comprises a first and a second bearing flank that are supported on their front end faces on an essentially cylindrical contact carrier while revealing a recess between the bearing flanks and said recess receives moving parts of the transmission mechanism.

The use of two bearing flanks that are preferably embodied in an essentially diametrically opposed manner renders it possible to place the bearing flanks next to one another, wherein a recess remains in the housing between the bearing flanks and moving parts of the transmission mechanism can be received in said recess. By way of example, a deflection lever can be mounted in the recess and said lever can reverse the direction of a linear movement in a oscillating manner during a switching movement. The supporting arrangement of the bearing flanks and therefore the transmission mechanism chassis on their front end faces on an essentially cylindrical contact carrier, in particular on a hollow cylindrical contact carrier having an essentially circular cross section, renders it possible to direct forces in the direction of the cylinder axis into the contact carrier and thus to embody planar transitions for the purpose of directing forces to the contact carrier. Forces can be directed directly from the bearing flanks into the contact carrier. By way of example it can be provided that the bearing flanks are screwed by way of threaded pins into threaded recesses of the contact carrier that are provided on the front end face of the contact carrier. For this purpose, the bearing flanks can comprise corresponding shapes, such as for example a transverse crosspiece, in order to embody supporting feet. The transverse crosspiece preferably spans the supporting element. The transverse crosspiece can be formed in alignment essentially overlapping with respect to the supporting element (in particular in the case of using a connecting piece as a supporting element).

Furthermore, it can be advantageously provided that at least one bearing flank comprises a transverse crosspiece for the purpose of spanning an issuing opening of a cavity of the contact carrier and the arcing contact piece protrudes into said cavity, wherein the bearing flank extends over the issuing opening of the cavity.

The use of a transverse crosspiece renders it possible to embody in a simple manner supporting feet for the purpose of supporting the bearing flank. A transverse crosspiece is a support that is selectively supported and for its part offers a base to hold further apparatus, wherein the forces of the further apparatus are directed into supporting points of the transverse crosspiece. By way of example, the transverse crosspiece can span an issuing opening of a cavity of the contact carrier, wherein the bearing flanks abut against the transverse crosspiece so that the bearing flanks lie above the issuing opening. Advantageously, the issuing opening should be embodied in such a manner that in a projection in the direction of the cylinder axis the contour of the bearing flanks lies within the contour of the issuing opening in the projection direction as far as the front end face on the supporting feet of the transverse crosspiece that supports the contact carrier. Consequently, it is by way of example possible to allow the arcing contact piece to protrude into the contact carrier and to move the arcing contact piece at least in part out the contact carrier and by way of example to allow said arcing contact piece to protrude into the recess that is located between the bearing flanks. As a consequence, it is possible in the case of a switching on and a switching off process to displace the arcing contact piece within the recess of the bearing flank and the cavity of the contact carrier. The arcing contact piece is both guided on the supporting element and also guided within the recess between the bearing flanks for the purpose of coupling to the transmission mechanism.

A further advantageous embodiment can provide that on at least one of the bearing flanks a guiding track is arranged for the purpose of guiding a follower element that follows the guiding track.

The rated current contact pieces or rather the arcing contact pieces of the first or second switching contact set are preferably arranged in such a manner that they can be moved relative to one another along a movement axis. Accordingly, it is possible to provide a guide arrangement in a guiding track, by way of example in a channel that is followed by way of a follower element. A guiding track can be formed in different ways. This guiding track should preferably extend lengthwise. However, it can also be provided that the guiding track comprises a curvature whereby a movement is by way of example decelerated or accelerated. A guiding track can be embodied in different ways, by way of example the guiding track can be embodied as a connecting link, wherein its flanks are followed by means of the follower element. It can also be provided that the guiding track is formed as a groove, wherein the follower element can follow both a groove base and also groove flanks. An axial, rotationally secured guiding arrangement of an arcing contact piece is thus possible. The follower element can be designed differently according to requirements in such a manner that by way of example a cylinder that slides in the guiding track can be used. However, it can also be provided that annular discs or similar can act as a follower element. The follower element is moved along the extent of the guiding track, wherein the guiding track and the follower element remain connected with one another. The follower element follows the predetermined path of the guiding track.

A further advantageous embodiment can provide that a guiding track for the arcing contact piece is arranged in the recess.

The use of a guiding track within the recess renders it possible for parts that can move relative to one another to slide. By way of example, the arcing contact piece can support itself on the guiding track that is by way of example formed on the bearing flank. A permanent guiding and directing arrangement of the arcing contact piece can thus be achieved in a simple manner so that the arcing contact piece is on the one hand guided on a supporting element that is connected to the contact carrier and on the other hand a guiding arrangement is achieved in the guiding track so that in the extent of a linear movement rail of the arcing contact piece, a support and guiding arrangement of the arcing contact piece is provided on at least two support points, (for example supporting element and guiding track).

A further advantageous embodiment can provide that a movable field control electrode is guided on at least one bearing flank.

A field control electrode can be installed by way of example for the purpose of stabilizing a clearance between open contacts between the first switching contact set and the second switching contact set in a dielectric manner. A stabilizing arrangement of this type can be effective preferably in the switched-off state of the switching arrangement so that the mutually opposite rated current contact pieces or rather arcing contact pieces are shielded in a dielectric manner in the separated state, whereby a spontaneous penetration of the clearance between open contacts between the two switching contact sets is impaired. However, it can also be provided that the field control electrode improves the dielectric contour of the switching contact sets in the switched-on state. The field control electrode can be embodied in the form of an annular electrode that surrounds the arcing contact piece of the first switching contact set and is for its part surrounded by the rated current contact piece of the first switching contact set. Accordingly, the field control electrode can be displaced in its position along the same axis as the arcing contact piece, wherein preferably a movement that is aligned opposite with respect to one another of the first arcing contact piece of the first switching contact set and the field control electrode is performed so that in the case of a switching on process, the arcing contact piece of the first switching contact set is moved in the direction of the second switching contact set, whereas the field control electrode is remote from the second switching contact set. In the reverse case, during a switching-off process, the arcing contact piece of the first switching contact set should be moved away from the second switching contact set, whereas the field control electrode moves in the direction of the second switching contact set in order to shield in a dielectric manner the front of the first switching contact set that protrudes in an opposing manner to the second switching contact set. By way of example, a guiding arrangement can be achieved within the guiding tracks that are by way of example integrated into the bearing flanks. As a result of correspondingly forming the guiding tracks, a movement profile of the field control electrode that deviates with respect to the movement profile of the arcing contact piece can also be generated. By way of example, a connecting link guiding arrangement can be installed. As a result of a curved embodiment of the guiding track (transverse with respect to the movement axis of the arcing contact piece), it is possible to bring to a standstill/decelerate the field control electrode while a driven arcing contact piece is moving.

BRIEF DESCRIPTION OF THE SEVERAL VIEWS OF THE DRAWING

An exemplary embodiment of the invention is illustrated schematically herein under in a drawing and subsequently further described. In the drawings

DESCRIPTION OF THE INVENTION

Figure 1:
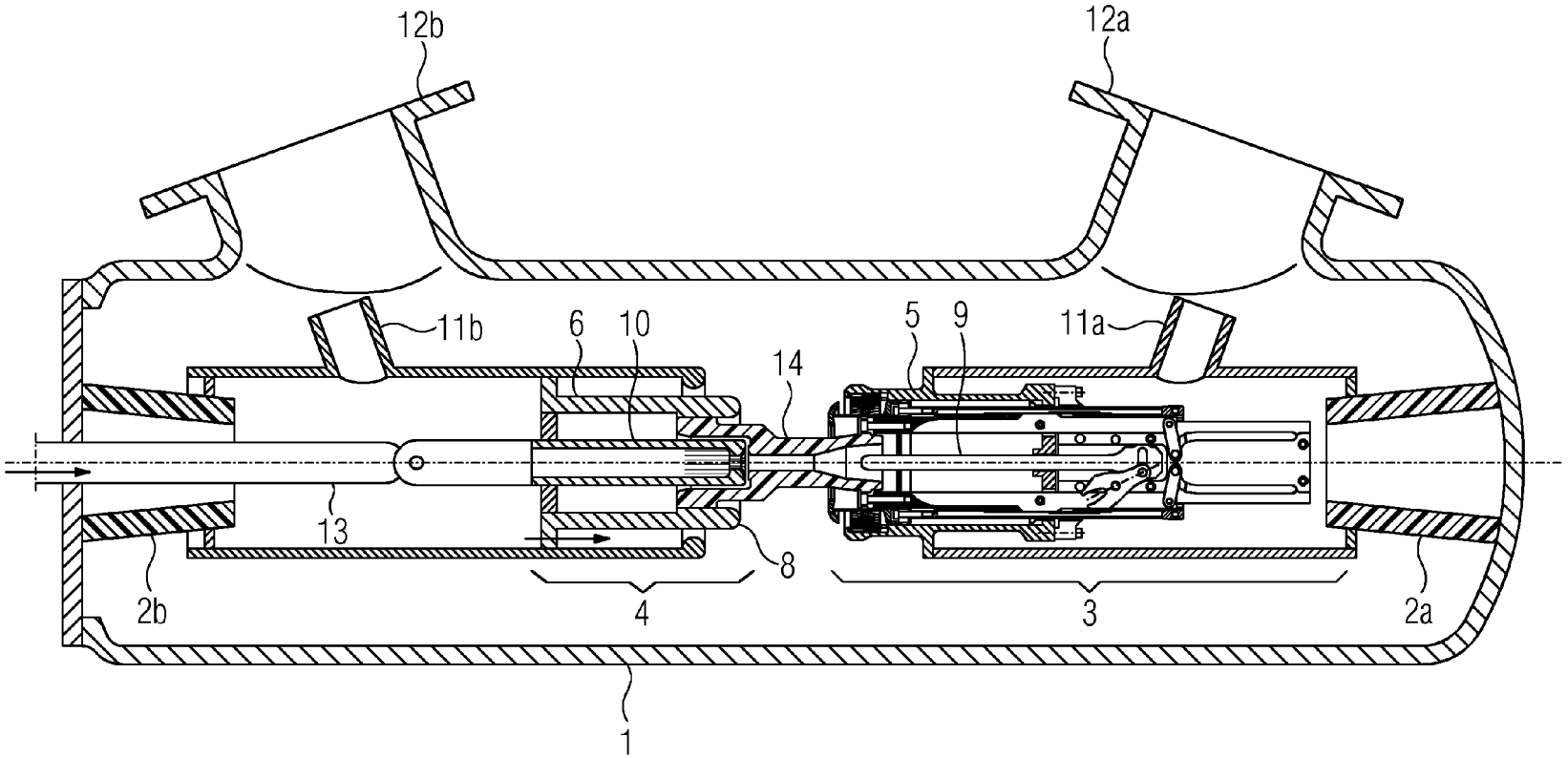
FIG. 1 illustrates a detail of a switching arrangement.

FIG. 1 illustrates a detail of a switching arrangement in the form of a high voltage circuit breaker. The switching arrangement comprises a fluid-tight encapsulating housing 1. The fluid-tight encapsulating housing 1 is in this case embodied as a pressure vessel that is filled in its interior with an electrically insulating fluid, preferably an electrically insulating gas such as sulfur hexafluoride. The fluid that is received within the encapsulating housing 1 is placed under excess pressure. Accordingly, in the assembled state, the interior of the encapsulating housing 1 is hermetically sealed. Furthermore, an interrupter unit of the switching arrangement is arranged within the encapsulating housing 1. In this case, the circuit breaker unit comprises a first switching contact set 3 and also a second switching contact set 4. The first and the second switching contact set 3, 4 are supported in each case by way of an insulating support 2*a*, 2*b* on ends that are remote from one another on the inner peripheral face of the encapsulating housing 1. The first switching contact set 3 comprises a first contact carrier 5. The second switching contact set 4 comprises a second contact carrier 6. A first rated current contact piece 7 of the first switching contact set 3 is supported by way of the first contact carrier 5. A second rated current contact piece 8 of the second switching contact set 4 is positioned on the second contact carrier 6. Furthermore, a first arcing contact piece 9 of the first switching contact set 3 is positioned on the first contact carrier 5. Furthermore, a second arcing contact piece of the second switching contact set 4 is positioned on the second contact carrier 6. The contact pieces of the switching contact sets 3, 4 are arranged coaxially with respect to one another.

A contact element 11*a*, 11*b* is connected in an electrically conductive manner in each case to the first contact carrier 5 and also to the second contact carrier 6 and said contact elements render it possible to contact and integrate the switching contact sets 3, 4 of the contact carriers 5, 6 of the switching arrangement into a current path so that it is possible to switch in or alternatively switch out the current path by means of the switching arrangement. In this case, the two contact elements 11*a*, 11*b* of the first and the second contact carrier 5, 6 are arranged in each case on the outer peripheral face of an essentially hollow cylindrical shield bodies. The second contact carrier 6 is essentially embodied in a hollow cylindrical manner and at least in part surrounded by a hollow cylindrical shield body that supports a contact element 11*b*. The first contact carrier 5 is embodied in an essentially hollow cylindrical manner and is at least in part surrounded by a hollow cylindrical shield body that supports a contact element 11*a*.

The hollow cylindrical shield body is used as a shielding cap in order to shield the contours of the contact carrier 5, 6 in a dielectric manner and also to connect connecting lines by way of the contact elements 11*a*, 11*b*. Connecting lines can be inserted into the interior of the encapsulating housing 1 by way of flanges 12*a*, 12*b* that are arranged on the encapsulating housing 1. The connecting lines that are to be inserted can be sealed on the flanges 12*a*, 12*b* in a fluid-tight manner and can be inserted into the interior of the encapsulating housing 1 in an electrically insulated manner so that it is rendered possible to close the interior of the encapsulating housing 1 in a hermetically sealed manner. By way of example, exterior bushings can be attached to the flanges 12*a*, 12*b* for the purpose of inserting connecting lines. A current path to the switching contact sets 3, 4 is embodied from the respective contact elements 11*a*, 11*b* by way of the respective shield body and the respective contact carrier 5, 6.

The two contact carriers 5, 6 are constructed in an essentially hollow cylindrical manner, wherein the two contact carriers 5, 6 are essentially embodied with a circular cross section and are arranged with their front end faces lying opposite one another in a coaxial manner. Accordingly, the front end faces of the rated current contact pieces 7, 8 and also the arcing contact pieces 9, 10 of the two switching contact sets 3, 4 lie in the region of a clearance between open contacts. In this case, the second rated current contact piece 8 is constructed in a hollow cylindrical tubular manner. The first rated current contact piece 7 is embodied in the form of a bushing. As contact is made, the second rated current contact piece 8 can travel into the first rated current contact piece 7. The first arcing contact piece 9 is embodied in the form of a pin, wherein the second arcing contact piece 10 is constructed in the form of a bushing and is provided with resilient contact fingers so that the second arcing contact piece 10 can move over the outer peripheral face of the pin-shaped first arcing contact piece 9 in the switched-on state. The second arcing contact piece 10 and also the second rated current contact piece 8 are arranged coaxially with respect to one another, wherein the second arcing contact piece 10 is surrounded on its outer peripheral face by the second rated current contact piece 8, wherein the second rated current contact piece 8 is in turn encompassed on its outer peripheral face by the hollow cylinder shield body that supports a contact element 11*b*. The second rated current contact piece 8 and also the second arcing contact piece 10 are permanently contacted to one another in a galvanic manner so that these two contact pieces 8, 10 are permanently at the same electrical potential. The second rated current contact piece 8 and also the second arcing contact piece 10 are connected to one another in an angular rigid manner. The second rated current contact piece 8 is mounted within the hollow chamber of the hollow cylindrical shield body in such a manner that it can be axially displaced in a sliding manner and is connected to the hollow cylindrical shield body in an electrically conductive manner.

It is possible, by way of a drive device (not illustrated) that is located outside the encapsulating housing 1, to transfer a switching movement initially to the second rated current contact piece 8 and the second arcing contact piece 10 while using a kinematic chain. For this purpose, a drive rod 13 is provided within the kinematic chain. The drive rod 13 is arranged by way of example in such a manner that it can be displaced in a linear manner, wherein the switching rod 13 is guided in a fluid-tight manner through the encapsulating housing 1. A linear movement of the second rated current contact piece 8 and the second arcing contact piece 10 can be initiated by way of the switching rod 13. Furthermore, an insulating material nozzle 14 is provided that is connected in an angular rigid manner to the second rated current contact piece 8 and also to the second arcing contact piece 10. The insulating material nozzle 14 extends through the clearance between open contacts of the switching arrangement and protrudes in the direction of the first switching contact set 3. The insulating material nozzle 14 can be axially displaced together with the second rated current contact piece 8 and also with the second arcing contact piece 10. A drive rod 15*a*, 15*b* of a transmission mechanism is connected to the insulating material nozzle 14. The transmission mechanism is used to transfer a movement of the insulating material nozzle 14 or rather of the second rated current contact piece 8 and also of the second arcing contact piece 10 to the first arcing contact piece 9, wherein the linear movement of the insulating material nozzle 14 is reversed in terms of its direction by means of the transmission mechanism and is transferred to the first arcing contact piece 9. It is intended to use for this purpose a fixedly-mounted two-armed lever 16 that on the one hand can be driven by way of a pin 17 that is located on a drive rod 15*a* and on the other hand can output a movement to an elongated hole that extends transversely with respect to the direction of movement of the first arcing contact piece 9.

Figure 2:
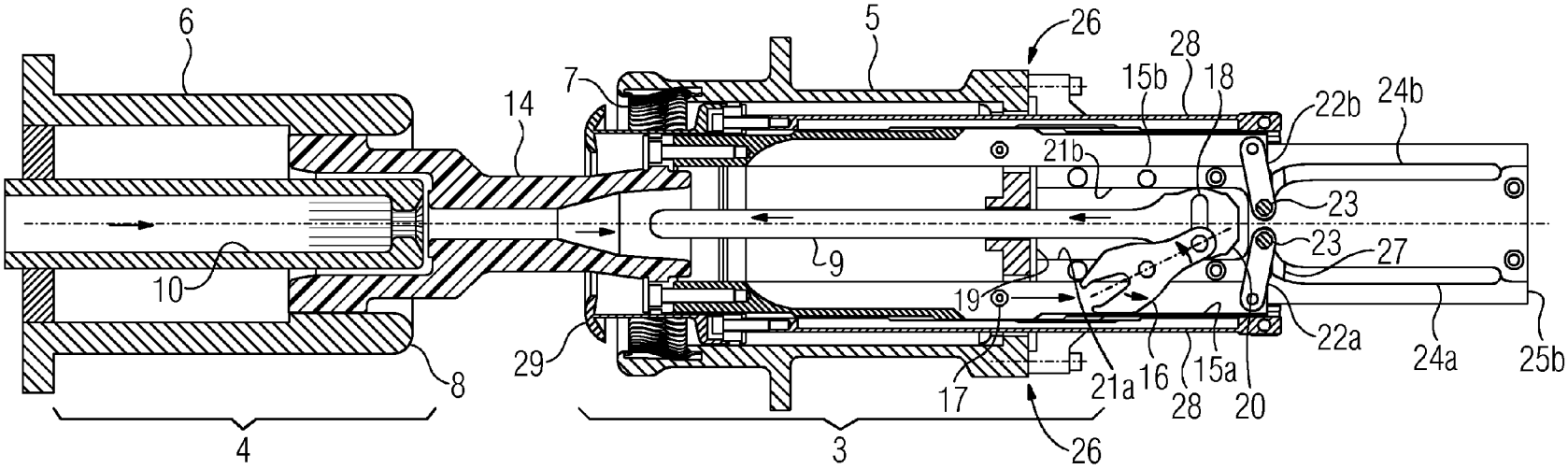
FIG. 2 illustrates a first and also a second switching contact set of the switching arrangement that is disclosed in FIG. 1.

The construction of the transmission mechanism is further evident in FIG. 2. The first switching contact set 3 and also the second switching contact set 4 are illustrated in this figure.

The pin 17 that is fastened to a drive rod 15*a* that is mounted in such a manner that it can move with respect to the contact carrier 5 can engage in a first lever arm of the two-armed lever 16. The pin 17 moves during a switching movement into an open fork of the first lever arm of the two armed lever 16 and pivots the two-armed lever 16 about its fixedly-mounted bearing. A second lever arm of the two-armed lever 16 engages in an elongated hole 18 of the first arcing contact piece 9. As a result of the design of an elongated hole 18, it is possible to allow a pin of the two armed lever 16, said pin being coupled to the second lever arm and the arcing contact piece 9, to engage in the elongated hole 18 and thus to compensate for an over-stroke of the lever 16 and to render possible a linear movement of the first arcing contact piece 9. Consequently, it is possible that a movement of the insulating material nozzle 14 by way of a deflection transmission mechanism, in particular by way of the two-armed lever 16, is transformed into a linear movement of the first arcing contact piece 9, said linear movement being directed in the opposite direction with respect to the second switching contact set 4.

The arcing contact piece 9 is mounted in a supporting element 19. The supporting element 19 extends along a diameter within a cavity of the first contact carrier 5 and is embodied in accordance with a type of a connecting piece that extends from the inner peripheral face to the inner peripheral face of the cavity. A bushing is provided in a central area and the first arcing contact piece 9 is mounted within said bushing in such a manner that it can be displaced in an axial manner. The supporting element 19 is connected in an electrically conductive manner to the first contact carrier 5 and also is permanently connected to the first arcing contact piece 9 in an electrically conductive manner by way of a sliding contact arrangement. A transmission mechanism head 20 of the first arcing contact piece 9, in which the elongated hole 18 is arranged, is arranged on the end of the first arcing contact piece 9 that is remote from the second arcing contact piece 10. The transmission mechanism head 20 is guided in groove-shaped guiding tracks 21*a*, 21*b* that are aligned opposite one another in such a manner that said transmission mechanism head can be displaced in a linear manner. The transmission mechanism head 20 acts as a follower element of the guiding tracks 21*a*, 21*b*. The guiding tracks 21*a*, 21*b* are embodied in each case as grooves so that, by way of a transverse guiding arrangement of the transmission mechanism head 20 and therefore in cooperation with the bushing of the supporting element 19, a rotationally secured linear guiding arrangement of the first arcing contact piece 9 is provided by way of the associated groove flanks of the guiding tracks 21*a*, 21*b*.

Furthermore, coupling elements 22*a*, 22*b* are arranged on the drive rods 15*a*, 15*b*. The coupling elements 22*a*, 22*b* connect the drive rods 15*a*, 15*b* in a pivotable manner to drive pins 23 and said driving rods are mounted in guiding tracks 24*a*, 24*b* in such a manner that they can be displaced. The guiding tracks 24*a*, 24*b* are embodied as connecting links (the recesses that run through the bearing flanks) that are integrated into bearing flanks 25*a*, 25*b*. The two bearing flanks 25*a*, 25*b* (as a result of the cut-away view only one bearing flank 25*b* is visible in FIG. 2) are embodied in a diametrically opposed manner. The bearing flanks 25*a*, 25*b* are used as a transmission mechanism chassis of the transmission mechanism to position by way of example the point of rotation of the two-armed lever 16, to guide the drive rods 15*a*, 15*b* in a linear direction, to position the guiding tracks 21*a*, 21*b*, 24*a*, 24*b* and to direct and guide the transmission mechanism head 20 of the first arcing contact piece 9. Moving parts of the transmission mechanism are arranged within a recess between the two bearing flanks 25*a*, 25*b* that complement one another. The bearing flanks 25*a*, 25*b* are part of an open transmission mechanism chassis. Both the first bearing flank 25*a* and also the second bearing flank 25*b* are screwed on their front end faces to the first contact carrier 5 (see arrow 26). For this purpose, the bearing flanks 25*a*, 25*b* comprise in each case a transverse crosspiece that extends over an issuing opening of the cavity of the first contact carrier 5 and render it possible to support the bearing flanks 25*a*, 25*b* and also the transmission mechanism directly on the first contact carrier 5 in such a manner that it is spaced to the supporting element 19.

By way of the drive pins 23 that are guided in the guiding tracks 24*a*, 24*b* in a displaceable manner, in the case of movement of the drive rods 15*a*, 15*b* a lug 27 performs a synchronized movement therewith and the drive pins 23 are mounted in said lug in a displaceable manner in a transverse direction with respect to the movement direction of the insulating material nozzle 14. Accordingly, a movement of the drive rods 15*a*, 15*b* can be transferred to holding arms 28 that are attached to the lug 27, and a field control electrode 29 is arranged on said holding arms. Consequently, it is possible to transfer a movement of the drive rods 15*a*, 15*b* to the holding arms 28 in order to bring about a movement of the field control electrode 29. The guiding tracks 24*a*, 24*b* are in part embodied in a curved manner transverse with respect to the movement axis of the insulating material nozzle 14 so that a dead-time element is formed that brings about a temporal delay of the transfer of movement of the drive rods 15*a*, 15*b* to the holding arms 28 of the field control electrode. Consequently, it is possible to effect a movement of the second rated current contact piece 8 and also of the second arcing contact piece 10 and also of the insulating material nozzle 14, wherein initially both the field control electrode 29 and also the first arcing contact piece 9 remain idle and only in the case of a preceding movement of the insulating material nozzle 14 along with the second rated current contact piece 8 and second arcing contact piece 10 does the pin 17 move into the fork end of the two-armed lever 16 and a movement of the first arcing contact piece 9 occurs, wherein depending upon the position of the guiding tracks 24*a*, 24*b* for the drive pins 23, a lead or a temporal offset/a delay of a movement in the opposite direction of the field control electrode 29 occurs. The field control electrode 29 is moved out of the first rated current contact piece 7 so that in the region in which in the switched off state (cf. FIG. 2) the field control electrode 29 is idle, the second rated current contact piece 8 can now be moved in order to contact the two rated current contact pieces 7, 8 in a galvanic manner.

Figure 3:
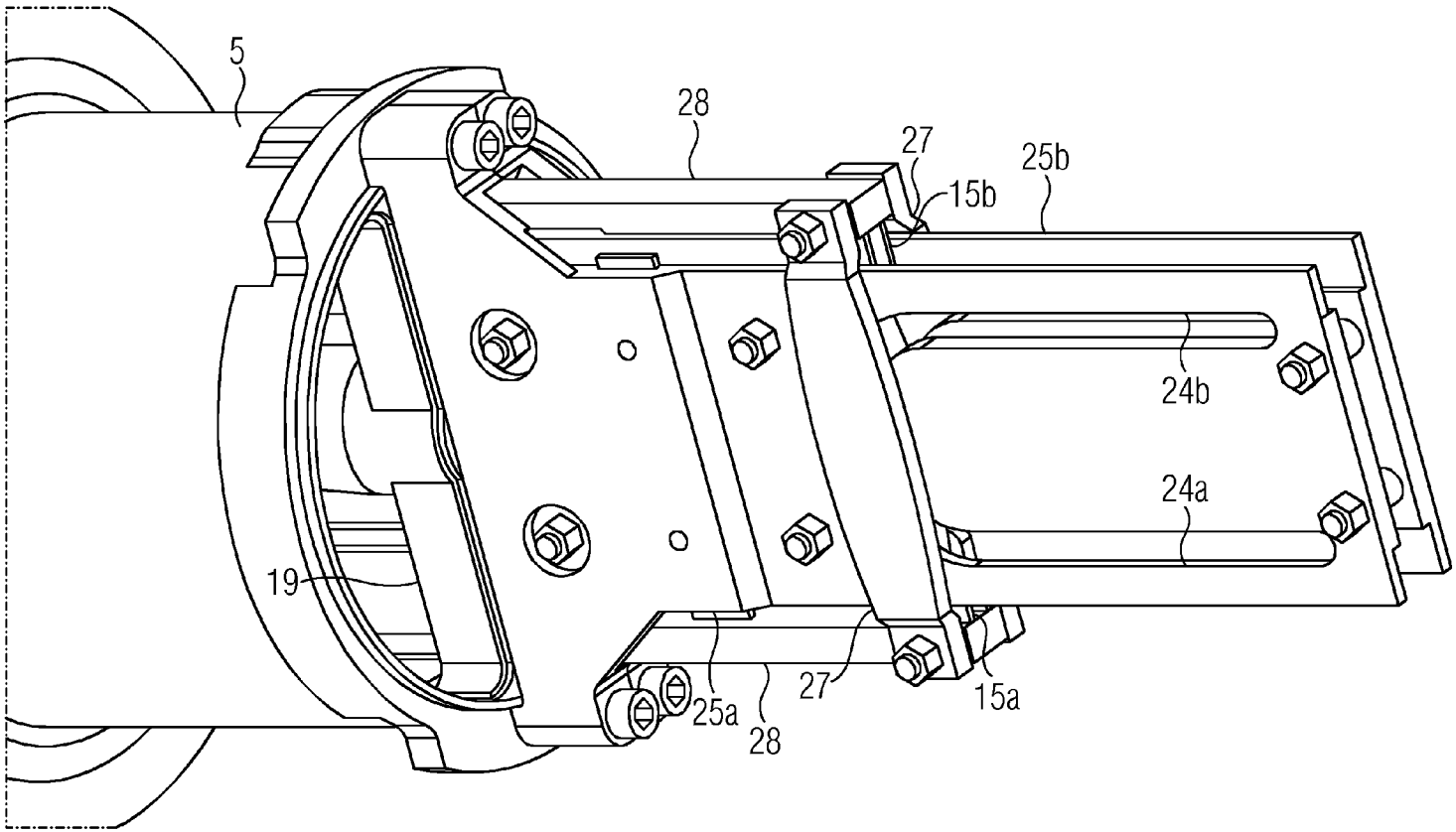
FIG. 3 illustrates a perspective view of the first switching contact set having bearing flanks that are supported on a contact carrier.

FIG. 3 illustrates a perspective view of the end of the first contact carrier 5 that is remote from the second switching contact set 4. The supporting element 19 that is embodied in a connecting piece like manner is evident within a cavity of the first contact carrier 5 and said supporting element is pushed through in a central region (arrow 30) of the first arcing contact piece 9 that is not illustrated in FIG. 3. The supporting element 19 is spanned by the bearing flanks 25*a*, 25*b* that are connected on their front end faces to the first switching contact carrier 5. The bearing flanks 25*a*, 25*b* comprise a transverse crosspiece on their end that is facing the first contact carrier 5 in order to attach supporting feet to the front end face of the first contact carrier 5. The supporting feet are screwed to the first contact carrier 5, wherein the bearing flanks 25*a*, 25*b* extend over the issuing opening of the cavity into which protrudes the first arcing contact piece 9. A recess is formed between the bearing flanks 25*a*, 25*b* and the two armed lever 16 is mounted in said recess and the guiding tracks 21*a*, 21*b* are also arranged in the recess for the transmission mechanism head 20 of the first arcing contact piece 9. The bearing flanks 25*a*, 25*b* consequently form a transmission mechanism chassis for the transmission mechanism, wherein moving parts of the transmission mechanism are held within a recess between the bearing flanks 25*a*, 25*b*.

The invention claimed is:

1. A switching configuration, comprising:

a first switching contact set having a rated current contact piece and an arcing contact piece being movable relative to one another;

said rated current contact piece having a contact carrier with a cavity having an orifice opening, said arcing contact piece protruding into said cavity;

a supporting element supporting said arcing contact piece on said contact carrier; and a transmission mechanism generating a relative movement between said arcing contact piece and said rated current contact piece, said transmission mechanism having a transmission mechanism chassis supported on said contact carrier;

said transmission mechanism chassis having at least one bearing flank supported directly on and fixed to said contact carrier, said at least one bearing flank spanning said supporting element at a spacing, and said at least one bearing flank including a transverse crosspiece spanning and extending over said orifice opening.

2. The switching configuration according to claim 1, wherein:

said contact carrier is substantially cylindrical;

said at least one bearing flank includes first and second bearing flanks having front end faces supported on said substantially cylindrical contact carrier; and said transmission mechanism has moving parts received by a recess formed between said bearing flanks.

3. The switching configuration according to claim 1, wherein:

said at least one bearing flank includes a plurality of bearing flanks;

a guiding track is disposed on at least one of said bearing flanks; and a follower element follows said guiding track and is guided by said guiding track.

4. The switching configuration according to claim 1, wherein said at least one bearing flank includes a plurality of bearing flanks having a recess formed therebetween, and a guiding track for guiding said arcing contact piece is disposed in said recess.

5. The switching configuration according to claim 1, wherein a movable field control electrode is guided on said at least one bearing flank.

6. The switching configuration according to claim 1, wherein said at least one bearing flank includes a plurality of bearing flanks extending beyond said transverse crosspiece and beyond said contact carrier.

* * * * *